US006591518B2

(12) United States Patent
Barberi

(10) Patent No.: US 6,591,518 B2
(45) Date of Patent: Jul. 15, 2003

(54) INTEGRAL EXPANDER SUPPORT BRACKETS FOR AIR KNIFE DRIER CASSETTES

(75) Inventor: Steve J Barberi, Corona, CA (US)

(73) Assignee: Technotrans America West, Inc., Corona, CA (US)

( * ) Notice: Subject to any disclaimer, the term of this patent is extended or adjusted under 35 U.S.C. 154(b) by 18 days.

(21) Appl. No.: 10/011,006

(22) Filed: Nov. 30, 2001

(65) Prior Publication Data

US 2002/0066204 A1 Jun. 6, 2002

Related U.S. Application Data

(60) Provisional application No. 60/250,455, filed on Dec. 1, 2000.

(51) Int. Cl.[7] ..... F26B 3/00

(52) U.S. Cl. ..... 34/465; 34/463; 34/510; 34/629; 34/636

(58) Field of Search ..... 34/459, 463, 465, 34/487, 510, 629, 636, 638

(56) References Cited

U.S. PATENT DOCUMENTS

| | | | | |
|---|---|---|---|---|
| 4,270,283 A | | 6/1981 | Ellis | |
| 4,575,952 A | | 3/1986 | Bodeman | |
| 4,622,761 A | | 11/1986 | Barth | |
| 4,719,708 A | | 1/1988 | Karlsson | |
| 4,833,794 A | | 5/1989 | Stibbe | |
| 4,882,992 A | | 11/1989 | Schmoeger | |
| 5,016,363 A | | 5/1991 | Kreiger | |
| 5,249,374 A | | 10/1993 | Henningsen | |
| 5,259,124 A | | 11/1993 | Poterala | |
| 5,396,716 A | | 3/1995 | Smart | |
| 5,502,788 A | * | 3/1996 | Platsch | 392/424 |
| 5,507,102 A | | 4/1996 | De Vroome | |
| 5,579,590 A | * | 12/1996 | Seidl et al. | 34/559 |
| 5,778,788 A | | 7/1998 | Petterson | |
| 5,966,836 A | | 10/1999 | Valdez, III | |
| 6,108,938 A | * | 8/2000 | Jones | 34/487 |
| 6,446,358 B1 | * | 9/2002 | Mitsumori et al. | 34/611 |

* cited by examiner

*Primary Examiner*—Ira S. Lazarus
*Assistant Examiner*—Kathryn S. O'Malley
(74) *Attorney, Agent, or Firm*—Philip H. Haymond

(57) ABSTRACT

A method and apparatus for is provided for supporting and connecting drier cassettes of an air knife type of drier. The drier cassettes exhaust air on traveling printed matter and are joined and supported by expander units that also exhaust air on the printed matter to increase drying efficiency. Gas or air is supplied to either the drier cassettes or the expander units or both and window apertures may be provided to allow the gas to communicate between the drier cassettes and the expander units. The relative exhaust pressures of the expander units and the drier cassettes may be regulated to create a pressure gradient on the printed matter as it travels through the exhaust so that the path of the paper suffers from less disruption.

45 Claims, 8 Drawing Sheets

FIG. 3
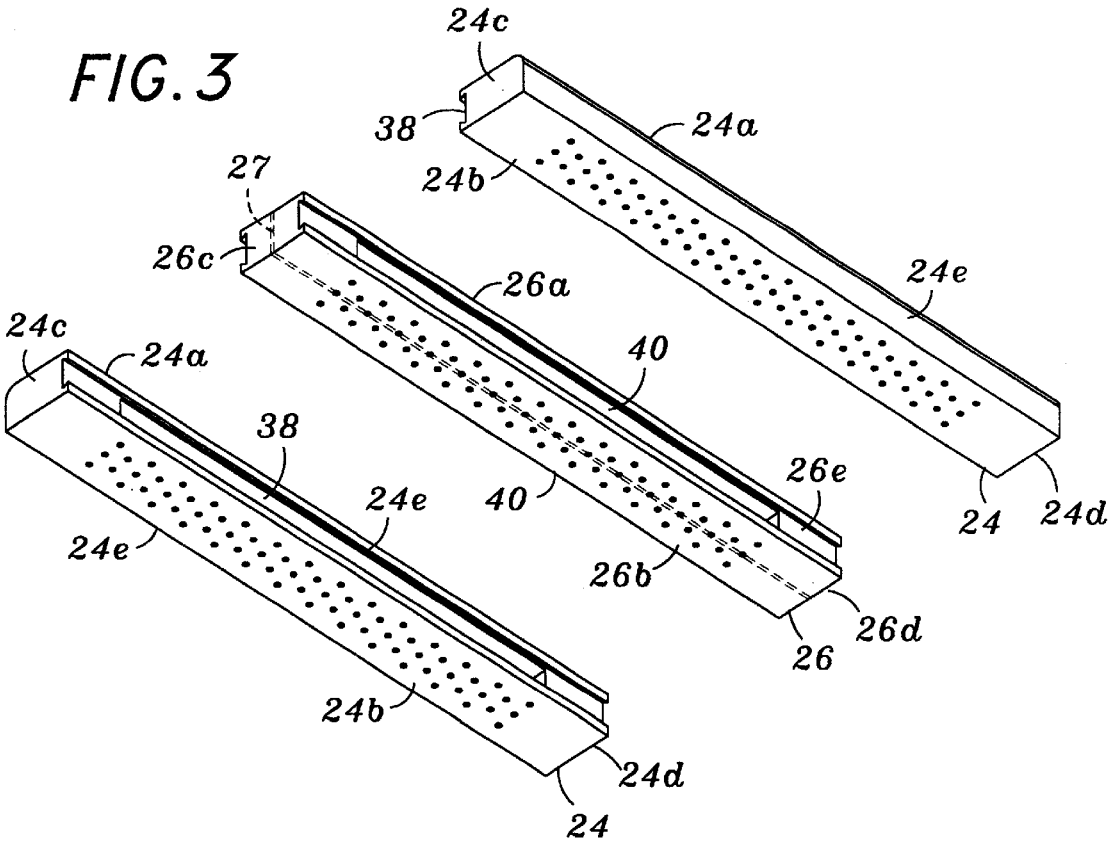
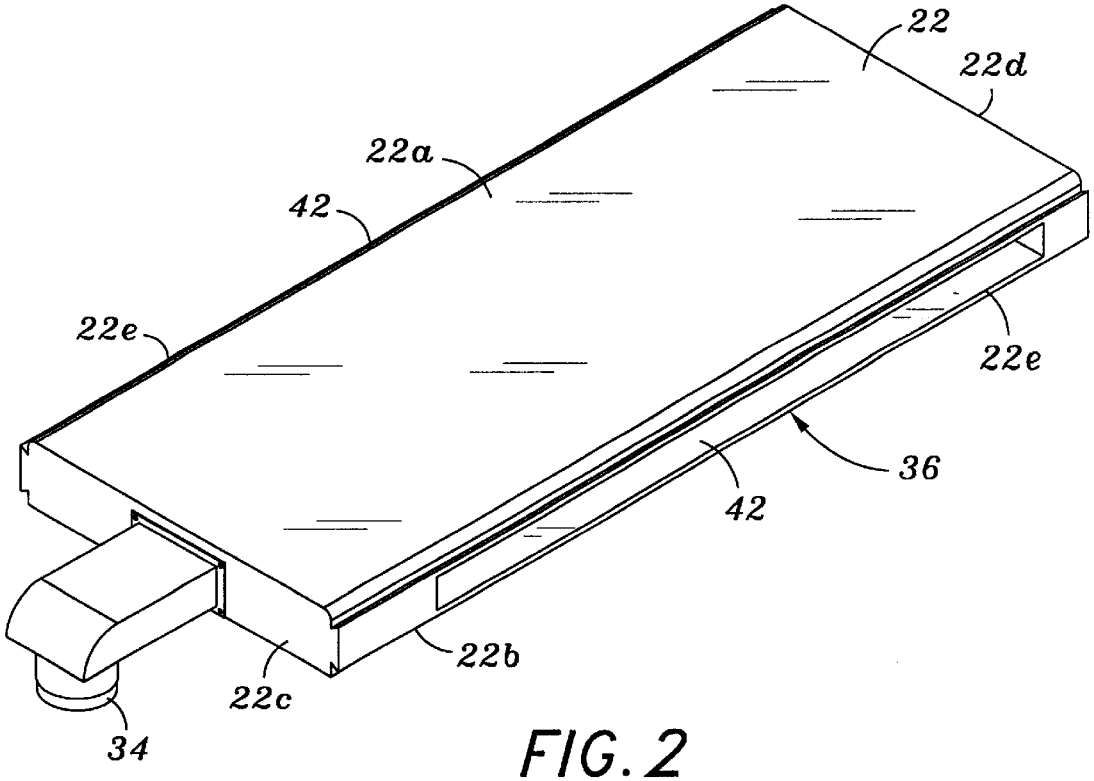
FIG. 2

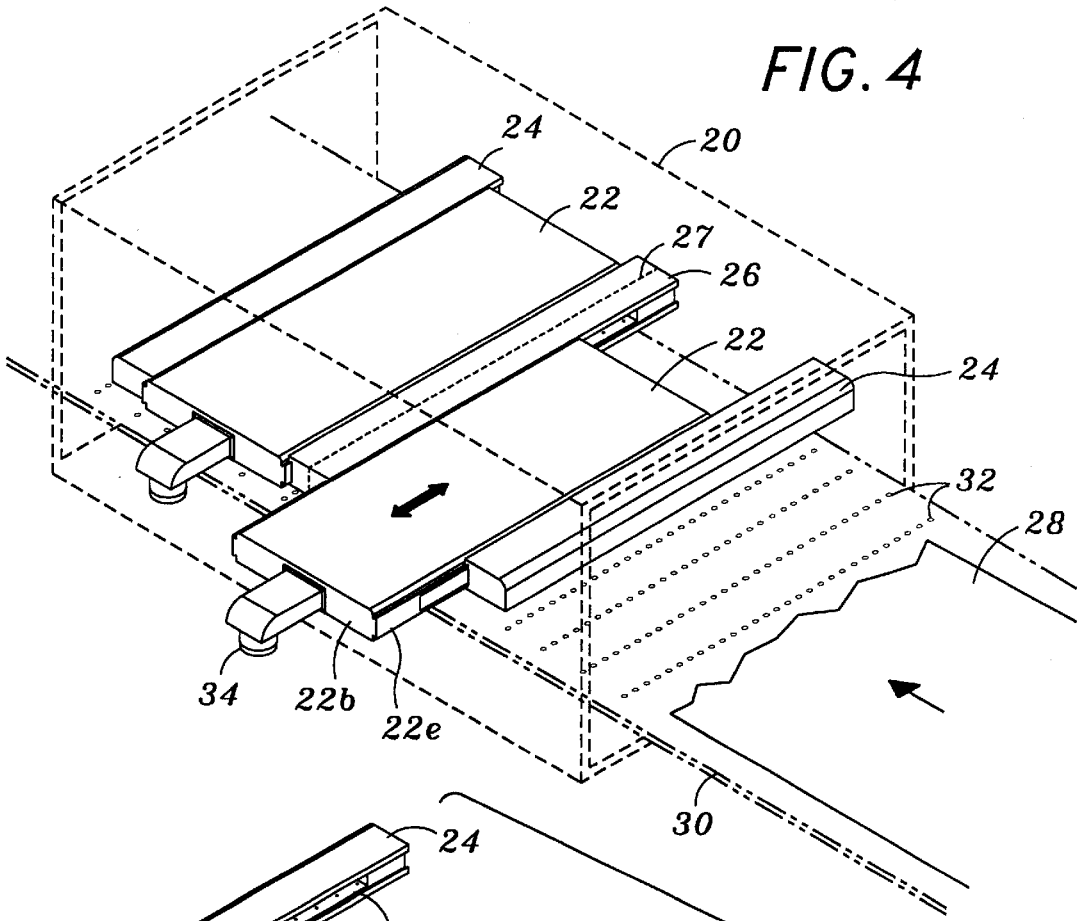
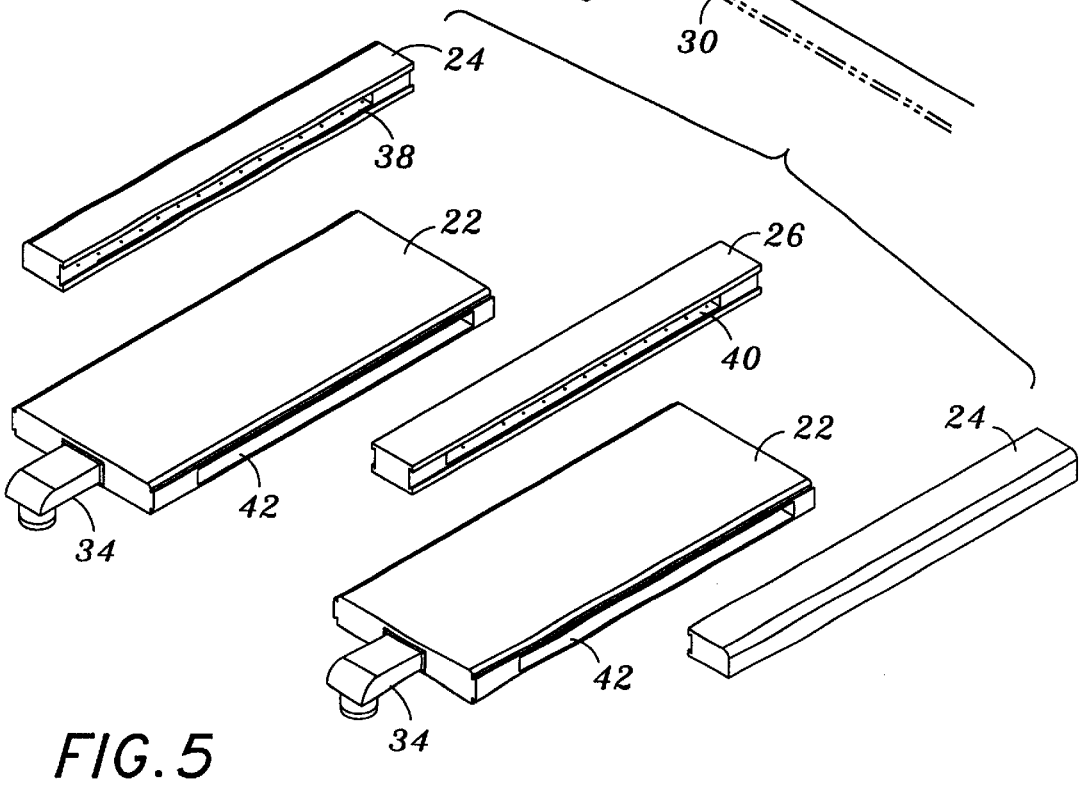
FIG. 5

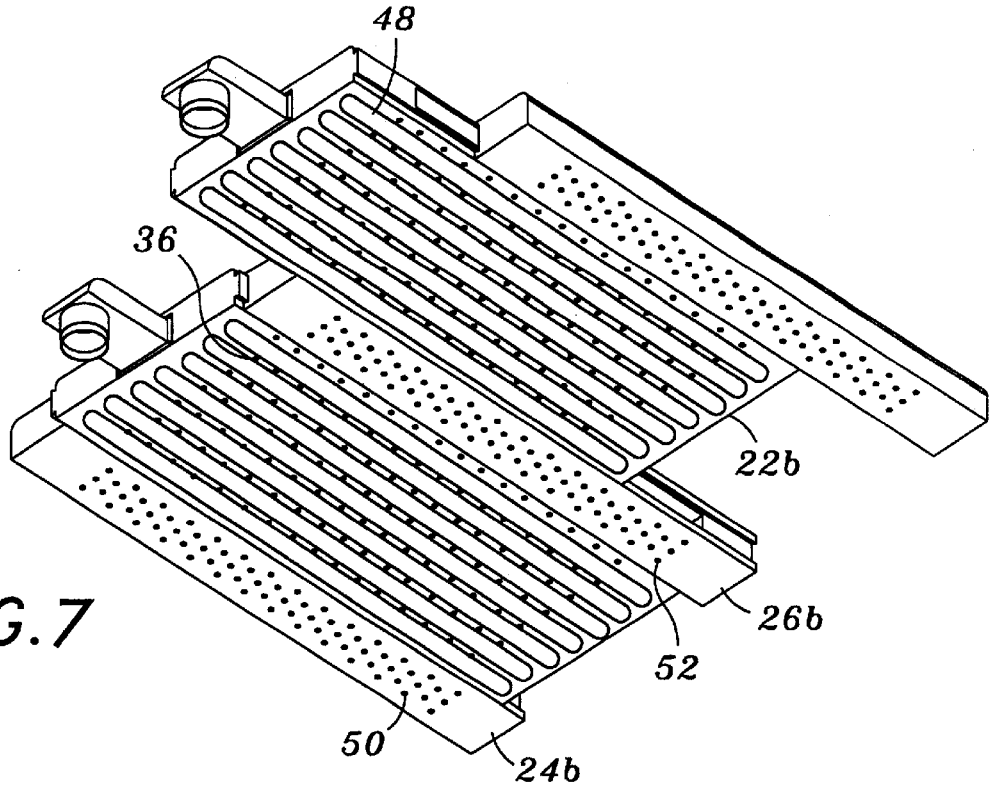
FIG. 7
FIG. 8
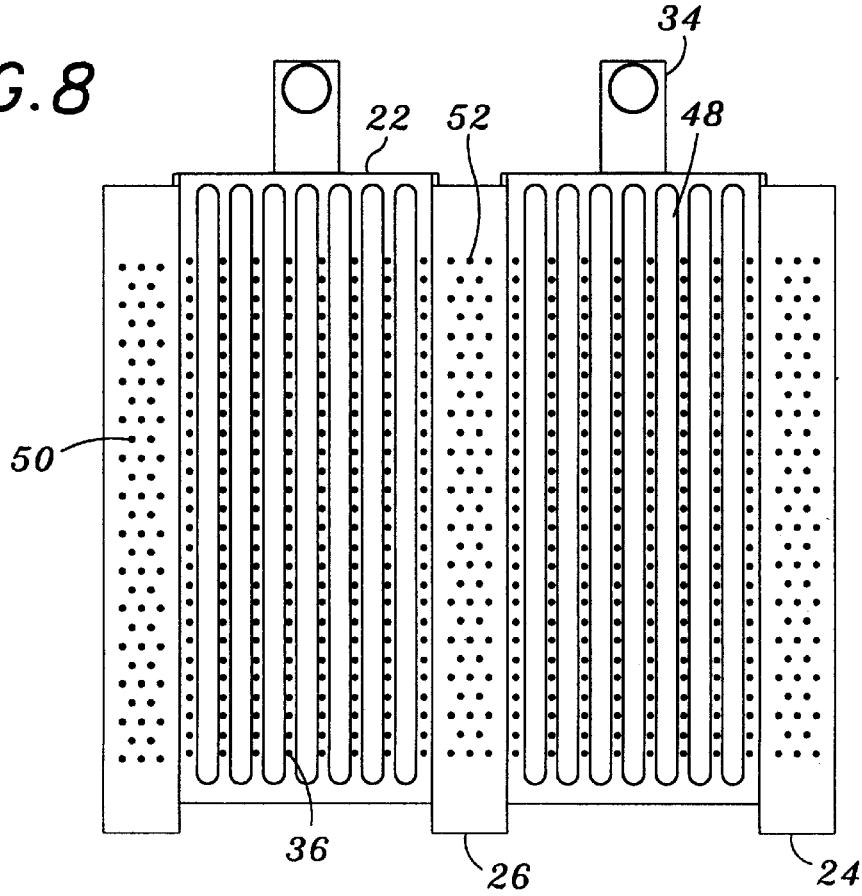

INTEGRAL EXPANDER SUPPORT BRACKETS FOR AIR KNIFE DRIER CASSETTES

This application cites and applicants hereby claim the priority of the filing date of U.S. provisional patent application Ser. No. 60/250,455, filed Dec. 1, 2000.

BACKGROUND OF THE INVENTION

1. Field of the Invention

This invention pertains to driers used to dry printed matter and more particularly to drier cassettes, mounting brackets and expander units for drier cassettes used in these driers for printed matter.

2. Description of Related Art

In the prior art wetted printed matter, such as a paper web or paper sheets, are dried in a drier after production by passing the printed matter under a series of individually mounted drier cassettes situated within the drier housing. These driers are, for example, used to dry printed matter from a sheet-fed offset printing press.

A drier cassette is essentially a box having an interior, an air input port to that interior and a plurality of exhaust openings on at least one side. Gas or air is pumped through the air input port into the interior and exhausts through the exhaust openings on the side of the box. In typical use the exhaust openings of the drier cassettes are oriented downwardly so that the printed matter may be successively carried under the drier cassettes on a track or conveyor belt, through the exhausting gas. A guide pan that both supports and moves the printed matter is frequently used to position the wet printed matter. The guide pan is a type of track having a multiplicity of holes exhausting air upwardly to support and move the printed matter.

A drier cassette may also include one or more radiant heat emitters, such as infrared emitters, to increase drying efficiency. These radiant heat emitters are mounted on a side of the drier cassette having the exhaust openings. As the printed matter is passed under the drier cassette exhaust the radiant heat emitter additionally warms the printed matter to aid drying. The exhaust disperses the additional humidity generated by the heating of the printed matter and otherwise further aids in the drying process.

This type of drier, employing a plurality of drier cassettes, is sometimes referred to as an air knife drier. A typical air knife drier includes series of drier cassettes that are releasably mounted on brackets fixedly attached to the housing of the drier or to framework within the housing of the drier. Although this type of drier configuration is typically directed to drying printed matter, the term "printed matter" as used herein is not limiting, but used as an example of a type of application to which the present invention may be applied. The invention might also be used for a sheet or ream of any material that may be dried or cooled after exiting a production unit or is otherwise amendable to being dried or cooled by an air knife drier, for example, the drying of fabric from a production unit producing a ream of fabric or other sheet material. The invention then, is not limited to any particular type of matter that may be dried.

The drying efficiency of using such a series of drier cassettes of the prior art is less than optimal, however, because the drier cassette mounting brackets present spaces or gaps between the drier cassettes where the printed matter is not exposed to either the radiant heating or to the exhausting gas or air. Moreover, as the printed matter passes under each successive drier cassette, the paper's path is disturbed or disrupted as it successively encounters the exhaust of each individual drier cassette. This disruption in the paper path can cause the paper to flutter or be misdirected, leading to jamming and limiting the speed at which the paper can be passed under the exhaust.

SUMMARY OF THE INVENTION

The inefficiencies of air knife driers of the prior art have been attenuated or eliminated by providing an expander unit for drier cassettes that is not only also a support bracket, but performs many of the drying functions of the drying cassette itself, eliminating the gaps or spaces occurring between the drier cassettes held by brackets of the prior art.

In a broad aspect the invention encompasses providing an expander unit, which acts as a stationary bracket for a drier cassette and that is also an enclosed box like a drier cassette, has an interior and is adapted to be supplied with a flow of gas to the interior, and, exhausts the gas through a plurality of exhaust openings. The expander unit is fixedly attached to a surface of the housing or framework within the drier and is adapted to be joined to and support one or more drier cassettes.

Another aspect of this invention is a drier cassette that is adapted to function with one or more expander units. Like a drier cassette of the prior art, the drier cassette of the present invention is an enclosure having an interior adapted to be supplied with a flow of gas to the interior and the gas exhausts through a plurality of exhaust openings on a side of the drier cassette. When the drier cassette of the present invention is joined together with one or more expander units, with their respective exhaust openings oriented in the same direction, the combination of one or more expander units and drier cassettes create an uninterrupted path of drying exhaust gas for printed matter to travel through.

In one embodiment the gas is supplied to either a first drier cassette or a first expander unit by sharing the gas supplied to a second drier cassette or to an expander unit. In the case where gas is supplied to the second expander unit, the gas communicates into an adjoining drier cassette through a conduit or interfacing exhaust openings. A window aperture, for example, may be provided in an expander unit and also provided in an adjoined drier cassette, so that the gas may communicate between the expander unit and the joined drier cassette through the two window apertures.

In the preferred embodiment the expander units are each formed as a rectangular box having top, bottom, front, back and two lengthwise sides. One or more of the lengthwise sides is adapted to releasably join to and support a drier cassette and the bottom side of the box has a plurality of exhaust openings to exhaust the gas. The expander units are mounted within the drier with their exhaust openings facing downwardly.

Where only a single lengthwise side of an expander unit is adapted to releasably join to a drier cassette, this unit is termed an end expander unit. Where both lengthwise sides of an expander unit are adapted to releasably join to a drier cassette, this unit is termed an intermediate expander unit.

The drier cassettes of the preferred embodiment of the present invention are also each formed as a rectangular box having top, bottom, front, back and two lengthwise sides, and in the preferred embodiment each of the lengthwise sides is adapted to be releasably joined to the expander unit. The bottom side of the drier cassette also has a plurality of exhaust openings to exhaust the gas.

One or more drier cassettes and one or more expander units are joined such that their bottom sides are oriented in the same direction, so that the exhaust openings of drier cassettes are oriented in the same direction as the exhaust openings of the expander units, causing the gas of these units to be exhausted in the same direction. Heat emitters, for example infrared tubes, are provided on the bottom side of the expander unit and are also provided on the bottom side of the drier cassette to enhance the drying process.

A series of drier cassettes releasably joined to expander units creates a cassette expander unit system for a drier for drying printed matter. Paper is moved in a direction under the cassette expander unit system. The series of drier cassettes and expander units comprises, discussed in the direction of paper flow, an end expander unit having a single window aperture in a single lengthwise side. This end expander unit is affixed to the housing or framework of the drier and releasably joined to support a drier cassette. The end expander unit is joined to a drier cassette having window apertures in both lengthwise sides, wherein each lengthwise side is formed to releasably join to and be supported by an expander unit. A second end expander unit having a single window aperture is releasably joined to the other side of the drier cassette, completing a simple cassette expander unit system.

In most driers, however, two or more drier cassettes are used. This necessitates the need for an intermediate expander unit having window apertures in both of its lengthwise sides in order to join two drier cassettes, one on each side. In this manner a series of drier cassettes and expander units can be releasably joined to create a continuous unit exhausting gas. For example, again discussed in the direction of paper flow, a first end expander unit is releasably joined to a first drier cassette. The first drier cassette is also releasably joined to an intermediate expander unit distal the first end expander unit. The intermediate expander unit is releasably joined to a second drier cassette distal the first drier cassette. The second drier cassette is also releasably joined to a second end expander unit, completing the system. In the preferred embodiment the end and intermediate expander units are fixedly attached to the drier housing or framework within the housing and the drier cassettes are inserted and removed from between the expander units.

Two such drier cassettes may, alternatively, be releasably joined directly to each other if the support of an intermediate expander unit support is not required.

Gas or air may be supplied to each expander unit and drier cassette with a separate air input port on each expander unit and drier cassette. If gas is supplied to all of the drier cassettes and the expander units through separate air input ports the window apertures may be eliminated because there is no need for gas to communicate between neighboring units through adjoining window apertures. In the preferred embodiment gas or air is only provided to the drier cassettes through an air input port on each drier cassette. Each expander unit includes a window aperture in the lengthwise side or sides of the expander unit that joins to a drier cassette, each drier cassette has a complementary window aperture in the lengthwise sides of the drier cassette that join to expander units.

In this manner when gas or air is supplied to the drier cassettes the gas will communicate to the adjoining expander units to supply the expander units with gas or air. When gas is supplied to the cassette expander unit system components in such an alternating configuration, supplying the drier cassettes only, or, supplying the expander units only, the units that are not supplied with gas or air should best have a containment wall subdividing the interior of the length of the box. The containment wall allows the interior gas pressure, and hence exhaust pressure, to be more easily maintained by limiting the total volume of the combined interiors of joined drier cassettes and expander units, which are to be supplied with a given air input. In embodiments where air or gas is instead supplied to an expander unit, and shared with a cassette drier, this containment wall will likely need to be placed to lengthwise divide the adjoining drier cassettes instead. The containment wall will be needed in most applications, but the requirement for this wall is a function of the required pressure for the application and the total volume of the chamber being supplied by a given volume of gas or air at a given pressure. This need for a containment wall may be determined for a particular application by simple application of design principals by one of ordinary skill in the art.

As printed matter travels in the guide pan towards the cassette expander unit system it encounters the leading edge of the combined exhaust of the series of releasably joined cassette driers and expander units, i.e. of a cassette expander unit system. The leading edge is the exhaust is generated through the outermost exhaust openings of the end unit. In most configurations the leading edge is the first exhaust openings exhaust generated by a first end expander unit encountered by the paper. With use of a guide pan the paper is carried on an upward cushion of air to under the cassette expander unit system. Upon encountering the downward exhaust at the leading edge the paper may ruffle and shift as the opposing upward and downward flows of air achieve equilibrium, causing a disruption in the path of the paper. The same phenomenon may occur when the printed matter exits the combined exhaust at the trailing edge, under the last, typically second, end expander unit.

The end units of a cassette expander unit system, whether they be drier cassettes or expander units, may be adapted to vary the exhaust emitted by them in order to control the disruption caused to the printed matter as it travels under the exhaust. One method and configuration calculated to attenuate this problem is adapting the unit, typically a first end expander unit, having the exhaust openings of the leading edge, to gradually increase the exhaust pressure on the printed matter as it travels from the leading edge towards the adjoining unit. Likewise, the unit at the trailing edge, typically a second end expander unit, may be adapted to gradually decrease its exhaust pressure on the printed matter as it exits the exhaust of the cassette expander unit system. Providing this pressure gradient at the leading and trailing edges of the cassette expander unit system decreases the ruffling of the printed matter as encounters the exhaust of the cassette expander unit system.

There are several ways to achieve this pressure gradient, and, more generally, to achieve any pressure variance in the cassette expander unit system. The exhaust openings of the leading and trailing edge end units of the cassette expander unit system, for example, may be provided with exhaust openings progressively increase in size or number from proximal to distal the exhaust openings of the leading edge. In this way a progressively greater downward exhaust is provided as the moving printed matter enters the exhaust at the leading edge of the combined exhaust, attenuating an abrupt change in downward exhaust pressure. In a similar manner progressively less downward exhaust is provided as the paper approaches the trailing edge of the combined exhaust, by configuring the second or last unit having the exhaust openings of the trailing edge with progressively smaller or fewer exhaust openings from distal to proximal the trailing edge.

In another embodiment, where an end unit is separately supplied with gas or air from an input port, that separate gas or air supply can be varied to increase or decrease the exhaust of that end unit.

In yet another embodiment, where the end units are supplied with gas or air from an adjoining unit, occluding chokes may be provided in the adjoining window apertures of a drier cassette and an end expander unit to limit the gas being shared with the end unit, thereby lessening the exhaust pressure.

In another yet embodiment the exhaust flow through the exhaust openings of an end expander unit is regulated by an occluding mask adapted to cover and occlude the exhaust openings. When the mask is moved over the exhaust openings the exhaust pressure of the end unit is decreased.

The drier cassettes and expander units may be releasably joined by a number of means. In the preferred embodiment a dovetail joint is used to join the lengthwise sides of the drier cassettes and the expander units that are adapted to be releasably joined. In the preferred embodiment one complementary half of the dovetail joint is machined into a drier cassette while the other complementary half of the dovetail joint is machined into an expander unit.

A method for drying printed matter is also provided, using the above apparatus. The method comprises the steps of providing a cassette expander unit system as described above, wherein the cassette expander unit system includes at least one expander unit; providing gas or air to the interior of one or more of the drier cassettes and expander units used, and, passing printed matter through the resulting exhaust through the exhaust openings of the cassette expander unit system.

One embodiment of the method for drying printed matter can be implemented by including an air input port on each expander unit to supply the interior of each expander unit with gas and also including an air input port on each drier cassette to supply the interior of each drier cassette with gas.

Alternatively in the method of the present invention an adjoining drier cassette and expander unit may share gas supplied to either through the use of conduits or apertures connecting an adjoining expander unit and drier cassette, allowing the gas to communicate therebetween. In the preferred method one or both lengthwise sides of an expander unit includes a window aperture and that lengthwise side is releasably joined to the lengthwise side of a drier cassette that also has a window aperture in its adjoined lengthwise side, whereby when gas is supplied to either it communicates between the interior of the drier cassette and the interior of the expander unit. This method eliminates the need for an air input port on each drier cassette and expander unit because the gas may be shared among the various components of the cassette expander unit system.

The method for drying printed matter may further include the step of using expander units that are regulated to emit gas at an exhaust pressure that is different from that of a drier cassette, at the leading and trailing edges of the cassette expander unit system. The various embodiments of such attenuated pressure end expander units, described above, may be used to achieve this.

In the preferred method all of the drier cassettes and any intermediate expander units have window apertures in both of their lengthwise sides, and, the end expander units having apertures in a single lengthwise side. The components are releasably joined to create a continuous unit to generate a more continuous exhaust to dry the paper because the gas can communicate between all adjoining expander units and drier cassettes.

Another aspect of the present invention is the method of passing printed matter under a drier of the construction recited above. A cassette expander unit system is provided, for a drier for drying printed matter, as described above. A supply of gas or air is provided to providing a supply of gas to one or more expander units acting as brackets and one or more drier cassettes, in order to cause one or more of the interiors of the drier cassettes and expander units to receive the gas and exhaust it through the unit's openings. The cassette expander unit system may be, for example but not by limitation, any of the above embodiments or their equivalents. Printed matter is then passed through the resulting exhaust from the exhaust openings of the drier cassettes and expander units to dry the printed matter more efficiently with a continuous path of air or gas.

This method may further include the step of attenuating the exhaust pressure of the drier cassettes or expander units at one or both ends of the air knife drier to attenuate the disruption to the paper path caused by the downward exhaust of the drying units. Typically the pressure at the leading and trailing edges of the paper path will be less so as to create a pressure gradient that gradually rises and falls as the paper passes through the exhaust. This gradient may be achieved by any of the above described embodiments or equivalent embodiment, for example but not limited to by providing exhaust openings in the bottom side of the box that progressively increase in size from distal to proximal the lengthwise side having a window aperture; by providing exhaust openings in the bottom side of the box that progressively increase in density from distal to proximal the lengthwise side having a window aperture; by providing a choke or an occluding mask adapted to cover and occlude the exhaust openings.

Together, one or more expander units joined to one or more drier cassettes, joined to allow gas or air to be exhausted from both a drier cassette and the an expander unit, comprise a cassette expander unit system for a drier for drying printed matter.

Another aspect of the present invention is the method of passing printed matter under a drier of the construction as recited in this description. A cassette expander unit system is provided, for a drier for drying printed matter, as described above. A supply of gas or air is provided to providing a supply of gas to one or more expander units acting as brackets and one or more drier cassettes, in order to cause one or more of the interiors of the drier cassettes and expander units to receive the gas and exhaust it through the unit's openings. The cassette expander unit system may be, for example but not by limitation, any of the above embodiments or their equivalents. Printed matter is then passed through the resulting exhaust from the exhaust openings of the drier cassettes and expander units to dry the printed matter more efficiently with a continuous path of air or gas.

This method may further include the step of attenuating the exhaust pressure of the drier cassettes or expander units at one or both ends of the air knife drier to attenuate the disruption to the paper path caused by the downward exhaust of the drying units. Typically the pressure at the leading and trailing edges of the paper path will be less so as to create a pressure gradient that gradually rises and falls as the paper passes through the exhaust. This gradient may be achieved by any of the above described embodiments or equivalent embodiment, for example but not limited to by providing exhaust openings in the bottom side of the box that progressively increase in size from distal to proximal the lengthwise side having a window aperture; by providing exhaust openings in the bottom side of the box that progressively increase in density from distal to proximal the lengthwise side having a window aperture; by providing a choke or an occluding mask adapted to cover and occlude the exhaust openings.

BRIEF DESCRIPTION OF THE DRAWINGS

FIG. 2 is a top orthogonal view of a drier cassette of the present invention.

FIG. 3 is bottom orthogonal view of the expander units of the present invention.

FIG. 4 is a top orthogonal view of a system embodiment of the present invention.

FIG. 5 is a top orthogonal exploded view of the separate components of the present invention.

FIG. 7 is a bottom orthogonal view of an embodiment of the expander units of the present invention releasably joined to an embodiment of drier cassettes of the present invention.

FIG. 8 is a bottom view of an embodiment of the expander units of the present invention releasably joined to an embodiment of drier cassettes of the present invention.

DETAILED DESCRIPTION

The following detailed description, and the figures to which it refers, are provided for the purpose of describing example(s) and specific embodiment(s) of the invention only and are not intended to exhaustively describe all possible examples and embodiments of the invention. In the following various figures identical elements and features are given the same reference number, and similar or corresponding elements and features are or may be given the same reference numbers followed by an a, b, c, and so on as appropriate for purposes of describing the various embodiments of the present invention.

Figure 1:
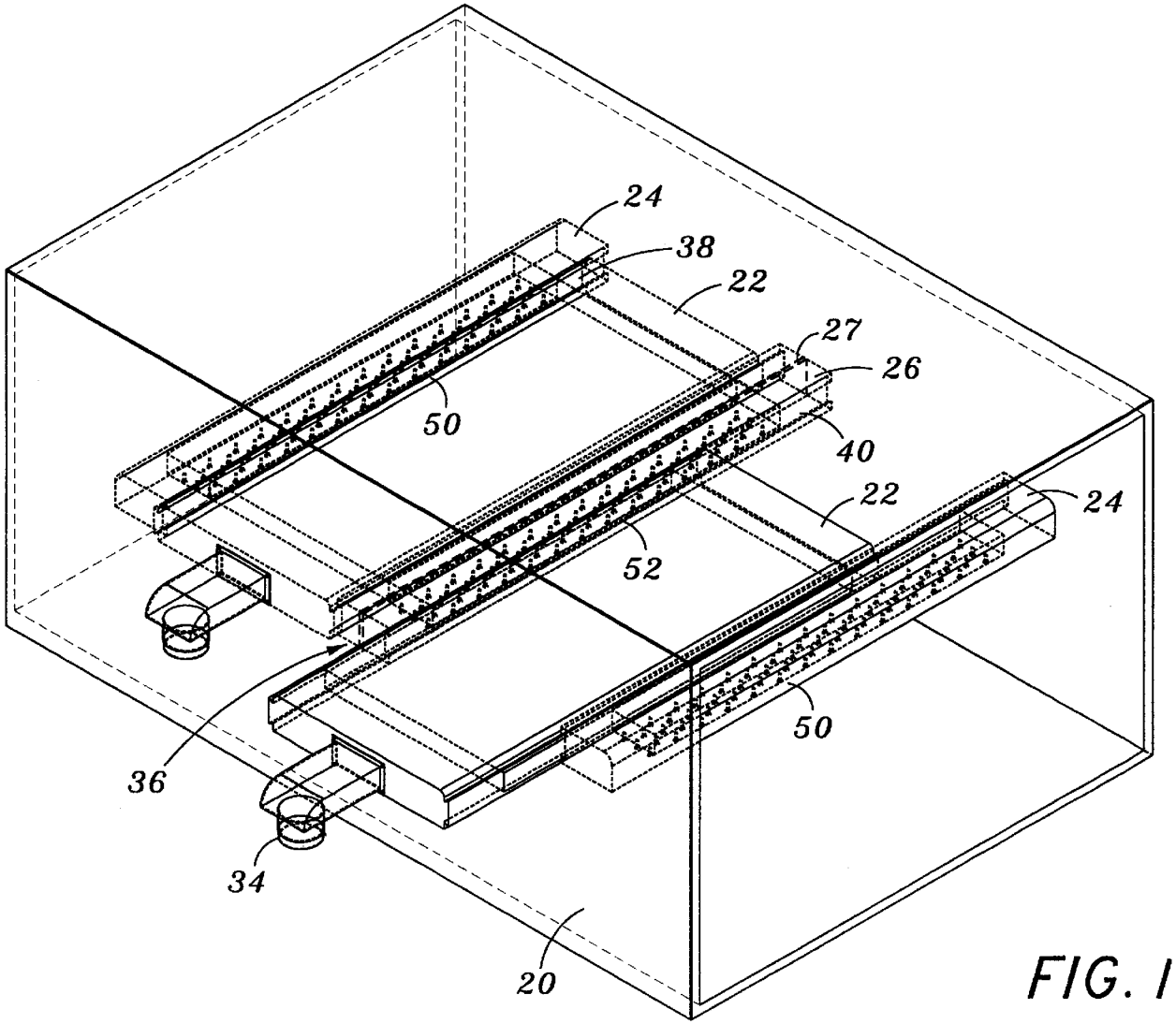
FIG. 1 is a cutaway top orthogonal view of an embodiment of the present invention.

Referring now to FIGS. 1–3 an embodiment of a drier for printed matter 20 of the present invention is shown. In this example each air knife type drier cassette 22 is supported on either side by two types of expander units, an end expander unit 24 and an intermediate expander unit 26. The drier cassette 22 is essentially a box, having a top side 22*a*, a bottom side 22*b*, a front side 22*c* a back side 22*d* and lengthwise sides 22*e*. Each expander unit also comprises a box, end expander unit 24 having a top side 24*a*, a bottom side 24*b*, a front side 24*c*, a back side 24*d* and lengthwise sides 24*e*; intermediate expander unit 26 having a top side 26*a*, a bottom side 26*b*, a front side 26*c*, a back side 26*d* and lengthwise sides 26*e*.

In the present invention there will usually be two end expander units 24, positioned to releasably join to and supporting the lengthwise sides 22*e* of the drier cassettes 22 with an end expander unit on either end of a series or row of drier cassettes. Intermediate expander units 26 releasably join to and support neighboring drier cassettes 22. A factor in producing sufficient pressure within the units is the volume of space of the chamber being supplied with air or gas. In this embodiment the intermediate expander unit 26 therefore, will usually require an internal containment wall 27 (dotted lines) that divides the intermediate expander unit lengthwise into two chambers in order to reduce chamber volume, to maintain sufficient pressure between that chamber and adjoining drier cassettes 22. Each drier cassette 22 in this embodiment has an air input port 34 through which air or other gas is pumped and a plurality of exhaust openings 36 on one side through which the gas exhausts. Air or any suitable gas may be pumped into the interior of the drier cassette and so the terms air and gas are used interchangeably herein. The air or gas may additionally be preheated or chilled, depending on the application and type of printed matter.

End expander units 24 and intermediate expander unit 26 are also essentially enclosed boxes having interiors, sized to be substantially the same length and height as that of the drier cassettes 22. The air pumped into the drier cassettes 22 is in pneumatic communication with the end expander units 24 and intermediate expander unit 26 through window apertures 42 in the drier cassettes and window apertures, 38 and 40 that are, in the preferred embodiment, provided along the lengthwise sides of the these components where they abut each other in the operating position. The intermediate and end expander units 24, 26 also have a plurality of exhaust openings 50, 52 on their bottom sides 24*b*, 26*b* substantially continuous with the bottom side 22*b* of the adjacent drier cassette, through which gas or air an expander exhausts onto printed matter passed under the bottom sides.

FIG. 2 shows a top perspective view of a drier cassette 22 of an embodiment of the present invention. Each drier cassette 22 is a box and has an air input port 34 through which air or other gas is pumped, a plurality of exhaust openings 36 on the bottom side 22*b* through which the gas exhausts (shown e.g. in FIGS. 6–13), and window apertures 42 on both lengthwise sides of the drier cassette's length. The bottom of the drier cassette typically includes heat emitters 48 (e.g. shown in FIG. 6), such as infrared emitters, and the exhaust openings 36 are disposed about the radiant heat emitters.

FIG. 3 shows is a bottom perspective view of end expander units 24 and a single intermediate expander unit 26 of the present invention, in relative operating orientation. End expander units 24 each have a single window aperture 38 to allow pneumatic communication with an adjoining drier cassette through the window aperture where they abut a drier cassette in the operating configuration. Intermediate expander 26 has window apertures 40 on both sides of the intermediate expander's lengthwise sides to allow pneumatic communication with both adjoining drier cassettes, and in this embodiment further has an internal containment wall 27 (shown where dotted line), where these components abut each other in the operating configuration.

Referring now to FIG. 4 a drier for printed matter 20 equipped with the present invention is shown, the housing is shown by dotted lines. The expander units 24 and 26 are fixedly attached to the housing. In this example each drier cassette 22 is releasably attached to and is supported on either lengthwise side 22*e* by an end expander unit 24 and the intermediate expander unit 26, and in this embodiment the intermediate expander unit further has an internal containment wall 27 (shown where dotted line). Printed matter 28 is moved (indicated by arrow) by a guide pan 30 (shown by dotted lines) between the guide pan and the bottom side of the drier cassettes 22*b* by air blown through exhaust openings 32 in the guide pan. In this embodiment each drier cassette 22 is slidably mounted for removal from and insertion into stationarily mounted end expander units 24 and intermediate expander unit 26 in the directions indicated by the double headed arrow.

In FIG. 5 the end expander units 24, drier cassettes 22 and intermediate expander unit 26 are shown in exploded view in roughly the relative orientation they would occupy from left to right in the housing of FIG. 4. The window aperture 38 of an end expander unit and the window aperture 40 of the intermediate expander unit are shown. Drier cassette window apertures 42 are also shown. When the drier cassettes 22 are positioned relative to the expander units 24, 26 in the operating position, as shown in FIGS. 8–12, the air or gas pumped into the drier cassettes through the input ports 34 also passes into the end expander units 24 and the intermediate expander unit 26. Similarly, as shown in FIG. 13, when air or gas is pumped into the input ports 66 of the end expander units 24 and intermediate expander unit 26, it passes to the drier cassettes 24. In the embodiment of FIG. 13 the containment wall 23 (shown in dotted lines) is fitted within the drier cassette 22.

Figure 6A:
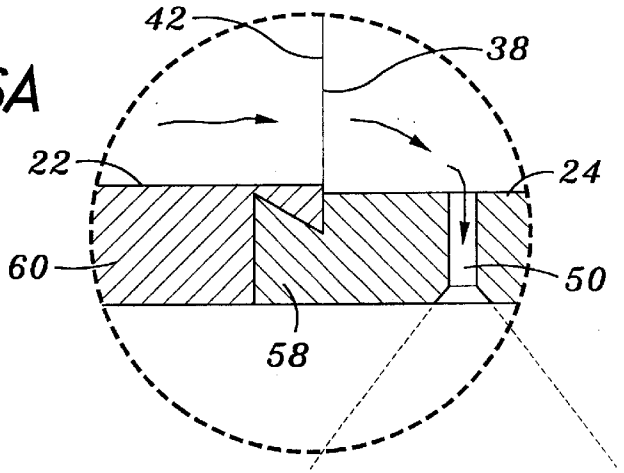
FIG. 6A is a is a detail view of the joint between the drier cassette and an end expander unit of FIG. 6.
Figure 6:
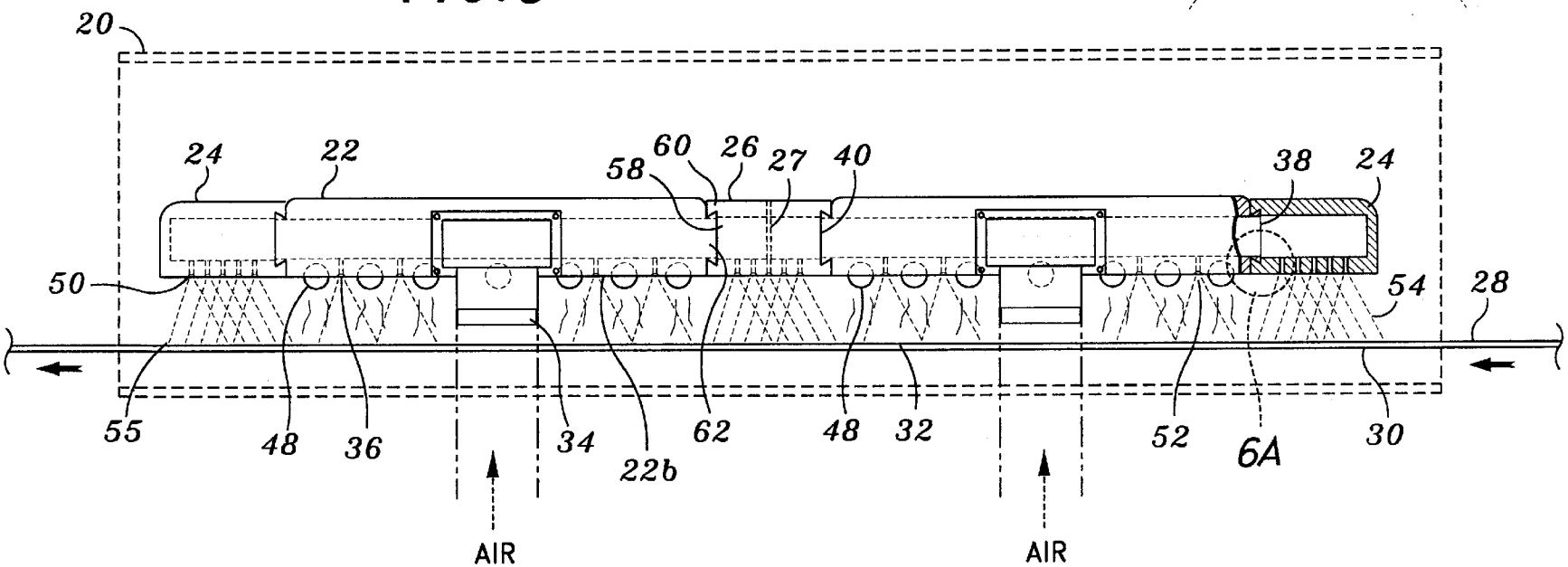
FIG. 6 is a cutaway elevation view of an embodiment the drier cassettes, expanders and system of the present invention.

FIG. 6 is a cutaway front elevation view of the components of FIG. 4 assembled for operation within a drier from printed matter 20. In this example each drier cassette 22 is supported on either side by an end expander unit 24 and an intermediate expander unit 26. Printed matter 28 is moved (indicated by arrow) by the guide pan 30 between the guide pan and the drier cassettes 22 with air blown upwardly through exhaust openings in the guide pan (not shown). In this embodiment each drier cassette 22 is slidably mounted for removal from and insertion into stationarily mounted end expander units 24 and intermediate expander unit 26, removable and insertable in the manner of a drawer.

Each drier cassette 22 is a box and has an air input port 34 through which air or other gas is pumped. End expander units 24 and intermediate expander unit 26 are also boxes, sized to be substantially the same length and height as that of the drier cassette 22. In this embodiment the intermediate expander unit further has an internal containment wall 27 (shown in dotted lines) to reduce volume so as to maintain pressure. The air pumped into the drier cassettes 22 is in pneumatic communication with the end expander units 24 and intermediate expander unit 26 through window apertures provided along the lengths of the components.

Printed matter 28 is moved (indicated by arrow) by a guide pan 30 between the guide pan and the drier cassettes 22 with air blown through exhaust openings in the guide pan 32. Each drier cassette 22 has an air input port 34 through which air or other gas is pumped, and a plurality of exhaust openings 36 on the bottom side 22*b* one side through which the gas exhausts. The drier cassette of this embodiment also has radiant heat emitters 48, such as infrared emitters, and the exhaust openings 36 are disposed about the radiant heat emitters. The air pumped into the drier cassettes 22 is in pneumatic communication with the end expander units 24 and intermediate expander unit 26 through window apertures, 38, 40 provided along the lengths of these components where they abut each other in the operating position. The end expander units have exhaust openings 50 and the intermediate expander unit has exhaust openings 52 through which the air exhausts (shown by dotted lines). FIG. 6A is a enlarged detail view of the path of the air pumped into a drier cassette 22. The air travels through drier cassette window aperture 42, the window aperture of the end expander unit 38 and exhausts through end expander unit exhaust openings 50.

In the presently preferred embodiment the drier cassettes 22 and the expander units 24 and 26 are attached with dovetail joints 58. The expander units 24 and 26 are formed with the female side of the dovetail joint 60 along their lengthwise sides 24*e* and 26*e* and the drier cassettes are formed with the complementary male side of the dovetail joint 62 along their lengthwise sides. In this manner the drier cassettes 22 can be removed or installed like drawers in the stationary expander units 24 and 26.

Referring now to FIGS. 7 and 8 the bottom sides 22*b*, 24*b* and 26*b* of the drier cassettes 22, supported on either side by an end expander unit 24 and an intermediate expander unit 26, of FIGS. 1 and 6 are shown. The drier cassettes 22 in the present embodiment have a plurality exhaust openings 36 on their bottom sides 22*b*, and also have radiant heat emitters 48, such as infrared emitters recessed into the bottom side of the drier cassettes. The end expander units 24 and the intermediate expander unit 26 are likewise equipped with exhaust openings 50 and 52. Air pumped into the drier cassettes 22 though input ports 34 exhausts through the openings 36, 50 and 52 to contact the printed matter being passed opposite the bottom side. FIG. 8 shows the end expander units 24, the drier cassettes 22 and the intermediate expander unit 26 in relative position during use.

In this manner the cubic capacity of the drier is advantageously increased and the printed matter undergoes a continuous length of distance of being blown dry. In the embodiment shown it is estimated that the capacity of the drier in this respect is increased by about thirty percent over the prior art. The volume of a typical drier cassette, for example, is about 3500 cubic inches and each expander unit adds about 990 additional cubic inches.

Another advantage of the present invention is that the printed matter will undergo fewer disruptions in its path of travel caused by the interface between the air being blown upwardly by the guide pan and the air being blown downwardly by the drier cassettes shown in FIG. 6. When drier cassettes are separately mounted on expander units with empty spaces between them there is typically some ruffling of the printed matter as it passes under the leading edge 54 and trailing edge 55 of the interface of the air being blown downwardly by each drier cassette as the printed matter passes beneath. In the prior art the moving printed matter therefore encounters these interfaces twice for each drier cassette as it passes through the drier and so there are two disruptions for each drier cassette. The present invention limits these disruptions to two by providing a single relatively uninterrupted length of downwardly blown air, thereby limiting these disruptions to a single leading edge 54 and a single trailing edge 55 of the two end expander units.

This problem of disruption of the printed matter travel path can be further attenuated by varying or limiting the volume or velocity of air or gas output by the end expander unit exhaust openings 50 relative to that of the drier cassettes 22 and the one or more intermediate expander units 26. When this is done the moving printed matter will first undergo a fraction of the increased downward air pressure at the leading edge 54 interface of the end expander unit, relative to that of the drier cassettes 22 and the one or more intermediate expander units 26, and thereby transition through a more slowly increasing pressure gradient before undergoing the full downward exhaust air pressure of the drier cassettes 22 and the one or more intermediate expander units 26. Similarly, when the printed matter exits from under the end expander unit exhaust openings 50 at the trailing edge of the interface 55, it will undergo a more slowly decreasing transition in pressure, a pressure gradient going from higher to a lower downward pressure of exhaust air.

It is contemplated that for some applications the pressure gradient may be reversed, with an initial higher pressure at the leading or trailing edges than that of the adjoining drier cassettes.

Figure 9:
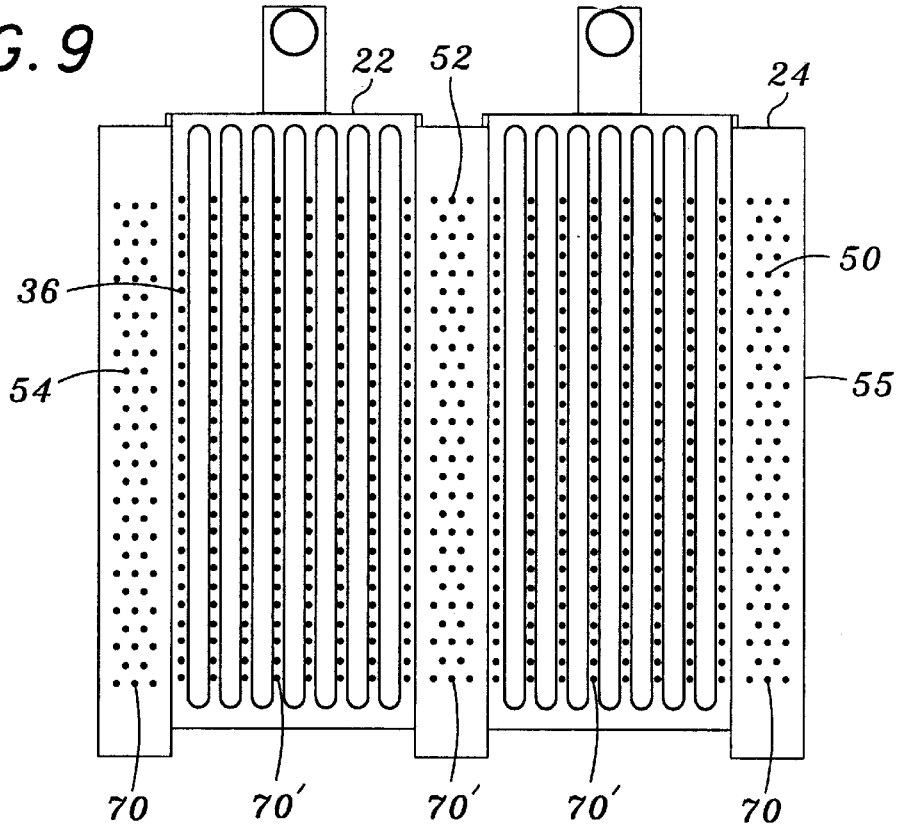
FIG. 9 is a bottom view of an embodiment of the expander units of the present invention releasably joined to an embodiment of drier cassettes of the present invention.

This pressure variation can be achieved in several ways by regulating the end expander unit to emit a lower exhaust pressure then the adjoining drier cassette, for example as shown in FIG. 9 by providing the end expander units 24 with smaller exhaust openings 50 than those of the drier cassettes 22. Printed matter passing under leading edge of the interface 54 will initially be blown downwardly by air exhausting from end expander unit exhaust openings 50 at a given pressure 70, increasing to a greater pressure 70' under drier expander units 22 and intermediate expander exhaust openings 52, then decreasing again to pressure 70 at end expander unit exhaust openings 50 of the trailing edge 55. Alternatively the exhaust openings of the end expander units may be made progressively larger from distal the window aperture of each end expander unit, allowing progressively more gas or air to exhaust from the leading edge as the printed matter passes under the exhaust and allowing progressively more less to exhaust from the trailing edge as the printed matter passes under the exhaust, shown magnified at 50*a*. Alternatively the exhaust openings of the end expander units may be made progressively greater in number, denser, from distal the window aperture of each end expander unit, allowing progressively more gas or air to exhaust from the leading edge as the printed matter passes under the exhaust and allowing progressively less to exhaust from the trailing edge as the printed matter passes under the exhaust, magnified at 50*b*.

Figure 10:
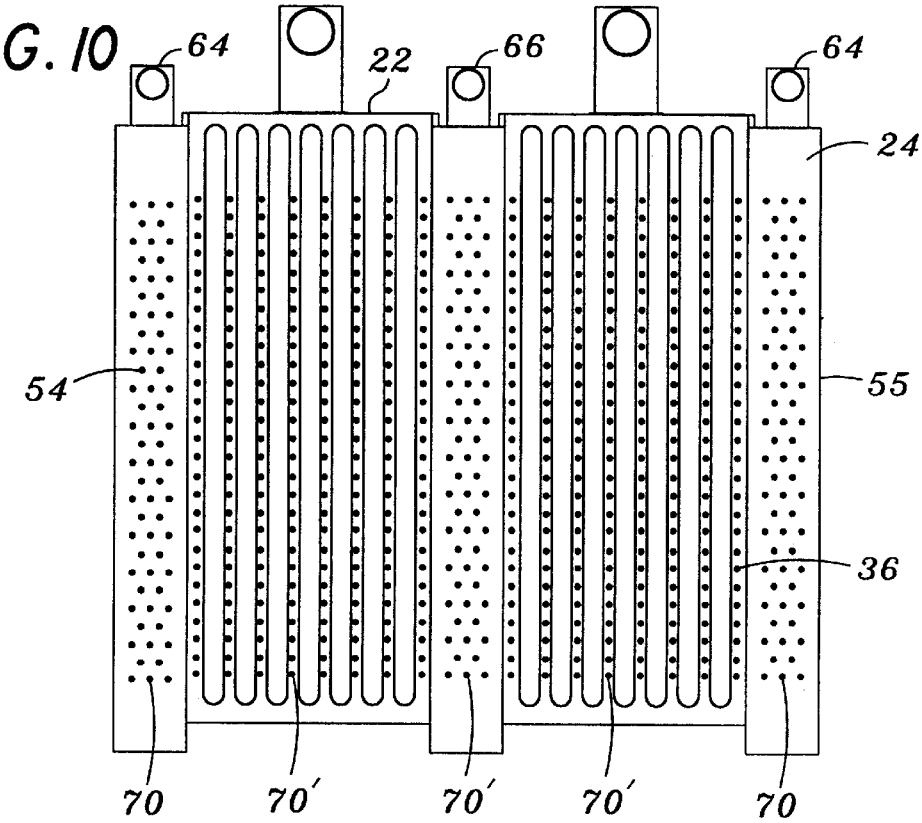
FIG. 10 is a bottom view of an embodiment of the expander units of the present invention releasably joined to an embodiment of drier cassettes of the present invention.

Another embodiment for varying the exhaust pressures to create a pressure gradient is shown in FIG. 10. In this embodiment neither the window apertures of the drier cassettes nor the window apertures of the expander units are present. Each drier cassette and expander unit is independently supplied with gas or air, although the gas or air source may be a common source. The end expanders 24 are individually provided with end expander air input ports 64. This configuration may alternatively be used in combination, shown as an example, with one or more of the expander units receiving gas or air from the adjoining lengthwise side window aperture of a drier cassette 22. Intermediate input port 66 (shown in dotted lines) must be included however if an intermediate expander unit 26 does not receive gas or air from an adjoining lengthwise side window aperture of a drier cassette 22. Different selected quantities or pressures of air can then be delivered individually to the drier cassettes and end expanders.

Printed matter passing under leading edge of the interface 54 will initially be blown downwardly by air exhausting from end expander unit exhaust openings 50 at a given pressure 70, increasing to a greater pressure 70' under drier expander units 22 and intermediate expander exhaust openings 52, then decreasing again to pressure 70 at end expander unit exhaust openings 50 of the trailing edge 55.

Figure 11:
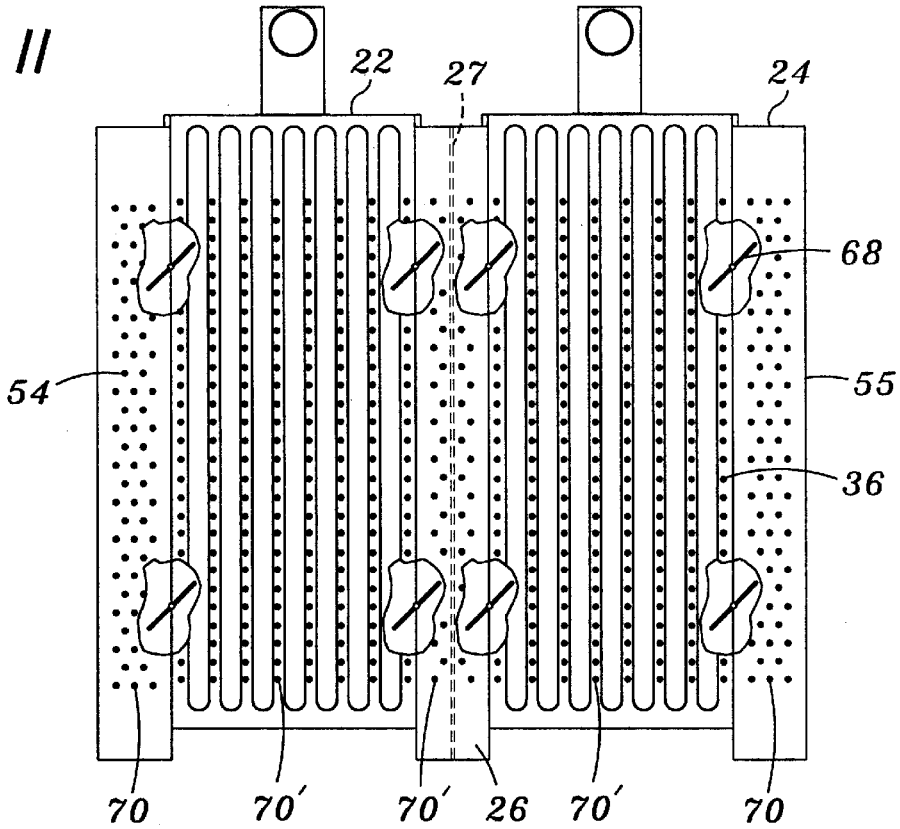
FIG. 11 is a bottom view of an embodiment of the expander units of the present invention releasably joined to an embodiment of drier cassettes of the present invention.

Yet another embodiment for varying the exhaust pressures to create a more slowly increasing and decreasing pressure gradient is shown in FIG. 11. The windows of the end expander units 24 and intermediate expander unit are selectively occluded by chokes 68, shown in cutaway view, varying the amounts of air delivered to the expander units. Printed matter passing under leading edge of the interface 54 will initially be blown downwardly by air exhausting from end expander unit exhaust openings 50 at a given pressure 70, increasing to a greater pressure 70' under drier expander units 22, and intermediate expander exhaust openings 52, then decreasing again to pressure 70 at end expander unit exhaust openings 50 of the trailing edge 55.

Figure 12:
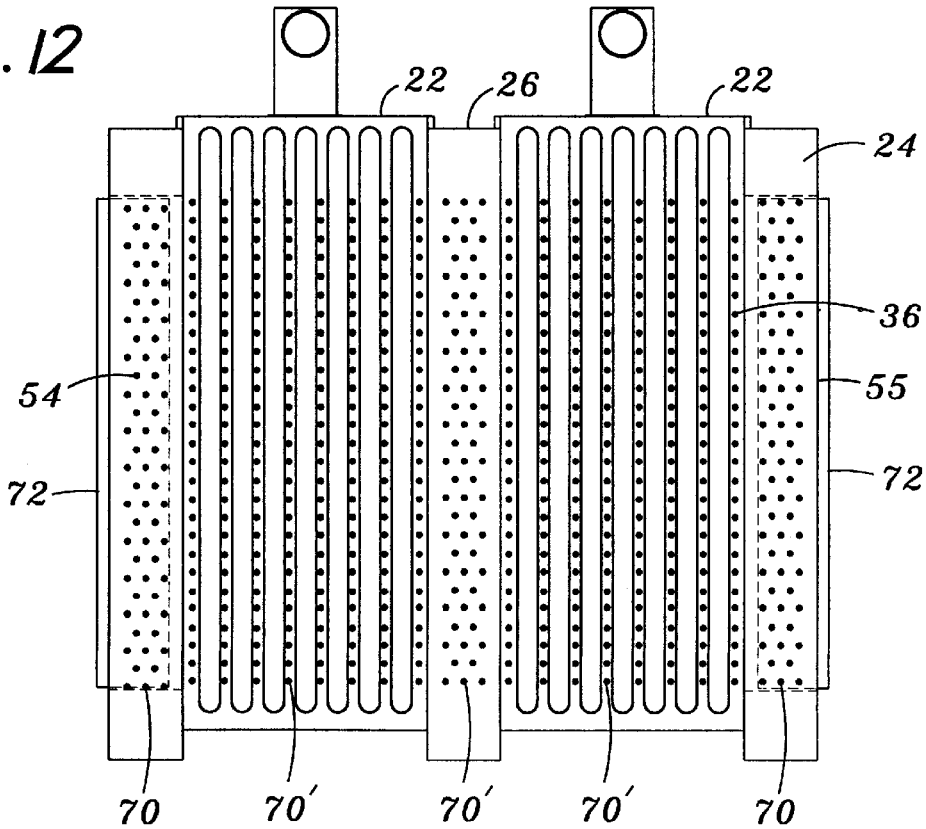
FIG. 12 is a bottom view of an embodiment of the expander units of the present invention releasably joined to an embodiment of drier cassettes of the present invention.
Figure 13:
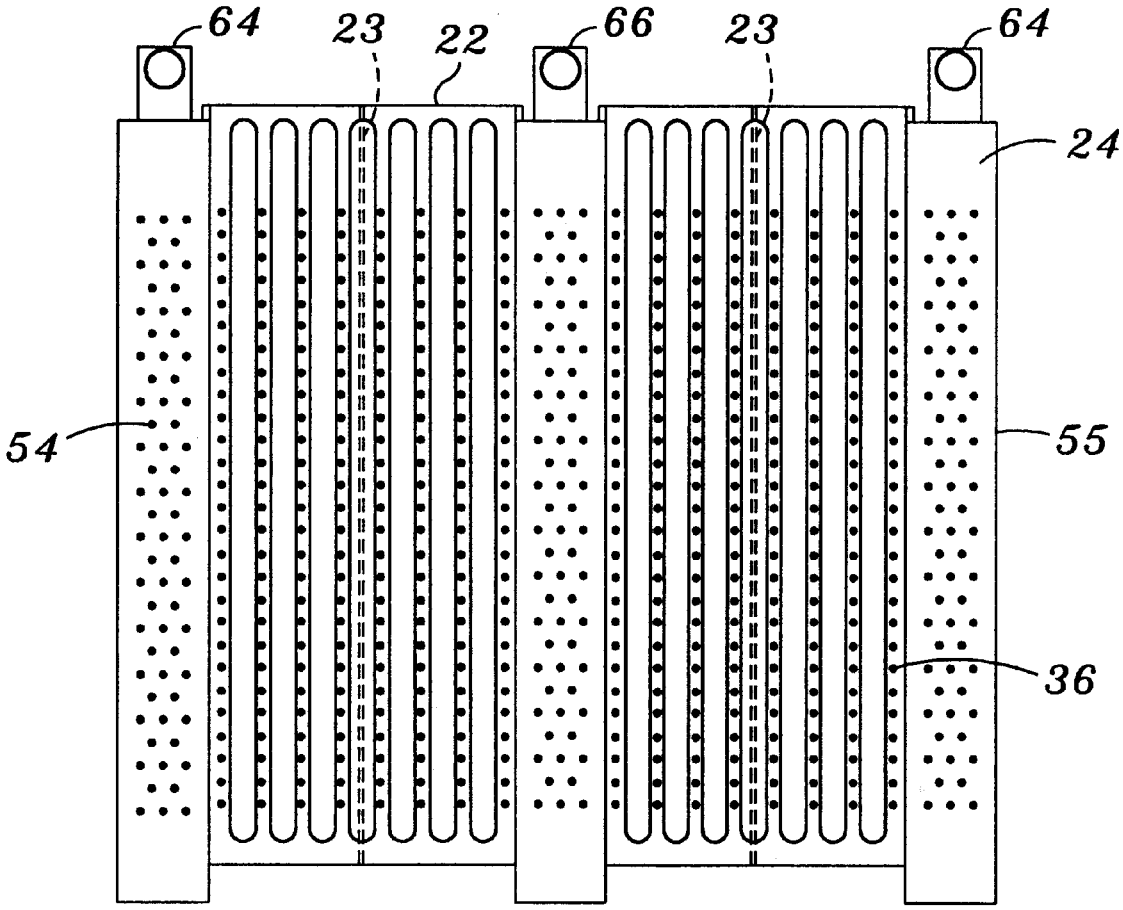
FIG. 13 is a bottom view of an embodiment of the expander units of the present invention releasably joined to an embodiment of drier cassettes of the present invention.

Yet another embodiment for varying the exhaust pressures to create a pressure gradient is shown in FIG. 12. The end expanders 24 may be selectively occluded by externally mounted masks to cover end expander exhaust openings 50, varying the amounts of air exhausted by the expander units. Printed matter passing under leading edge of the interface 54 will initially be blown downwardly by air exhausting from end expander unit exhaust openings 50 at a given pressure 70, increasing to a greater pressure 70' under drier expander units 22, and intermediate expander exhaust openings 52, then decreasing again to pressure 70 at end expander unit exhaust openings 50 of the trailing edge 55. The chokes may be sized so as not to interfere with a containment wall 27 if present.

Yet another embodiment for varying the exhaust pressures to create a pressure gradient is shown in FIG. 13. In this embodiment the expander units alone are supplied with gas or air, the gas or air source may be a common source. The end expanders 24 are individually provided with end expander air input ports 64. This configuration may alternatively be used in combination with the above pressure gradient producing configurations, for example, with the drier cassettes receiving gas or air from the adjoining lengthwise side window aperture of a drier cassette 22. Intermediate input port 66 supplies intermediate expander unit 26. The direr cassettes 22 are each divided by containment wall 23 to reduce volume to maintain pressure.

There are a multitude of releasable attachment configurations that may be employed to releasably affix and support the drier cassettes 22 to the expanders 24 and 26, for example the drier cassettes might be dropped between the expander units from above, etc. In the preferred embodiment a dovetail drawer support configuration is used, above, but is also used by way of example and is not intended to limit the type of attachment configuration used to connect a drier cassette to an end expander unit or an intermediate expander unit.

Another aspect of the present invention is the method of passing printed matter under a drier of the construction recited above. A cassette expander unit system is provided, for a drier for drying printed matter, as described above. A supply of gas or air is provided to providing a supply of gas to one or more expander units acting as brackets and one or more drier cassettes, in order to cause one or more of the interiors of the drier cassettes and expander units to receive the gas and exhaust it through the unit's openings. The cassette expander unit system may be, for example but not by limitation, any of the above embodiments or their equivalents. Printed matter is then passed through the resulting exhaust from the exhaust openings of the drier cassettes and expander units to dry the printed matter more efficiently with a continuous path of air or gas.

This method may further include the step of attenuating the exhaust pressure of the drier cassettes or expander units at one or both ends of the air knife drier to attenuate the disruption to the paper path caused by the downward exhaust of the drying units. Typically the pressure at the leading and trailing edges of the paper path will be less so as to create a pressure gradient that gradually rises and falls as the paper passes through the exhaust. This gradient may be achieved by any of the above described embodiments or equivalent embodiment, for example but not limited to by providing exhaust openings in the bottom side of the box that progressively increase in size from distal to proximal the lengthwise side having a window aperture; by providing exhaust openings in the bottom side of the box that progressively increase in density from distal to proximal the lengthwise side having a window aperture; by providing a choke or an occluding mask adapted to cover and occlude the exhaust openings.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. An expander unit for a drier for printed matter, comprising:

an enclosure having an interior, wherein the enclosure is adapted to be supplied with a flow of gas to the interior and to exhaust the gas through a plurality of exhaust openings, the enclosure being fixedly attached to a surface and adapted to releasably join to and support one or more drier cassettes, each drier cassette comprising an enclosure having an interior adapted to be supplied with a flow of gas and to exhaust the gas through a plurality of exhaust openings, whereby when one or more drier cassettes are releasably joined to the expander unit, the expander unit and the one or more drier cassettes exhaust gas in the same direction.

2. The expander unit for a receiving a drier for printed matter of claim 1 wherein the expander unit has a window aperture and is joined to a drier cassette that also has a window aperture, whereby the gas may communicate between the expander unit and the drier cassette through the window aperture.

3. The expander unit for a receiving a drier for printed matter of claim 1 wherein the exhaust openings of the expander unit exhaust gas at an exhaust pressure that is different from the exhaust pressure emitted by the exhaust openings of one of the one or more drier cassettes.

4. The expander unit for a receiving a drier for printed matter of claim 1 wherein the enclosure is a box having a top side, a bottom side, a front side, a back side and two lengthwise sides, one or more of the sides is adapted to releasably join to and support a drier cassette and the bottom side of the box has a plurality of exhaust openings to exhaust the gas.

5. The expander unit for a receiving a drier for printed matter of claim 4 wherein the expander unit includes an air input port to supply the interior of the expander unit with gas.

6. The expander unit for a receiving a drier for printed matter of claim 4 wherein one or both of the lengthwise side is adapted to releasably join and support a drier cassette and has a window aperture that, when joined with a drier cassette also having a window aperture in the side joined, the gas will communicate between the drier cassette and the expander unit.

7. The expander unit for a receiving a drier for printed matter of claim 6 wherein the expander unit is adapted to be joined on one lengthwise side and the exhaust openings in the bottom side of the box are regulated to emit a gas at an exhaust pressure that varies from that of an adjoining drier cassette exhaust pressure by providing exhaust openings in the bottom side of the box that progressively increase in size from distal to proximal the lengthwise side having a window aperture.

8. The expander unit for a receiving a drier for printed matter of claim 6 wherein the exhaust openings in the bottom side of the box are regulated to emit a gas at an exhaust pressure that varies from that of the adjoining drier cassette exhaust pressure by providing exhaust openings in the bottom side of the box that progressively increase in density from distal to proximal the lengthwise side having a window aperture.

9. The expander unit for a receiving a drier for printed matter of claim 6 wherein the exhaust openings in the bottom side of the box are regulated to emit a gas at an exhaust pressure that varies from that of the adjoining drier cassette exhaust pressure by providing an occluding choke in the window aperture.

10. The expander unit for a receiving a drier for printed matter of claim 6 wherein the exhaust openings in the bottom side of the box are regulated to emit a gas at an exhaust pressure that varies from that of the adjoining drier cassette exhaust pressure by providing an occluding mask adapted to cover and occlude the exhaust openings.

11. The expander unit for a receiving a drier for printed matter of claim 6 wherein the lengthwise sides that are adapted to join to and support a drier cassette are formed as part of a dovetail joint.

12. The expander unit for a receiving a drier for printed matter of claim 4 wherein the bottom side includes heat emitters.

13. The expander unit for a receiving a drier for printed matter of claim 6 wherein both of the lengthwise sides have a window aperture to supply the interior of the expander unit with gas and each of the lengthwise sides is adapted to join to and support a drier cassette.

14. The expander unit for a receiving a drier for printed matter of claim 13 wherein the least one of the lengthwise sides that is adapted to join to and support a drier cassette is formed as part of a complementary dovetail joint.

15. The expander unit for a receiving a drier for printed matter of claim 13 wherein the bottom side includes heat emitters.

16. A drier cassette, comprising:

a box having an interior that is adapted to be supplied with a flow of gas to the interior, that has a top side, a bottom side, a front side, a back side and two lengthwise sides, at least one of the sides being adapted to join to and be supported by an expander unit, the expander unit being comprised of a box having an interior that is fixedly attached to a surface and that has a top side, a bottom side, a front side, a back side and two lengthwise sides, at least one of the sides being adapted to join to and support a drier cassette, wherein at least one of the sides of the drier cassette that is adapted to be joined to the expander unit has a window aperture whereby when it is joined with an expander unit also having a window aperture in the side joined will allow gas to communicate between the drier cassette and the expander unit, and, the bottom side of the drier cassette has a plurality of exhaust openings to exhaust gas supplied to the interior.

17. The drier cassette of claim 16 wherein one or both of the lengthwise sides of the drier cassette is adapted to join to and be supported by a support expander unit.

18. The drier cassette of claim 17 wherein one of the one or both lengthwise sides forms a window aperture to supply the drier cassette with gas.

19. The drier cassette of claim 16 wherein the drier cassette has an air input port to supply the drier cassette with gas.

20. A cassette expander unit system for a drier for drying printed matter, comprising:

one or more expander units, each expander unit comprising a box that is fixedly attached to a surface and that has an interior, a top side, a bottom side, a front side, a back side and two lengthwise sides, at least one of the lengthwise sides being adapted to be releasably joined to and support a drier cassette, each expander unit being adapted to be supplied with a flow of gas to the interior and further where the bottom side of the expander unit has a plurality of exhaust openings to exhaust the gas, one or more drier cassettes, each comprising a box having an interior that has a top side, a bottom side, a front side, a back side and two lengthwise sides, at least one of the lengthwise sides being adapted to be releasably joined to and be supported by at least one expander unit or to be joined to a second drier cassette, the drier cassette being further adapted to be supplied with a flow of gas and a having a plurality of exhaust openings in the bottom side of the drier cassette to exhaust the gas, whereby when the one or more drier cassettes are joined to and supported by the one or more expander units such that the bottom sides of the expander units and the drier cassettes are oriented in the same direction, and, gas is supplied to an expander unit or to a drier cassette, the gas is exhausted through the exhaust openings of the one or more drier cassettes and the one or more expander units.

21. The cassette expander unit system for a drier for drying printed matter of claim 20 where a first drier cassette is adjoined to the second drier cassette.

22. The cassette expander unit system for a drier for drying printed matter of claim 20 wherein each expander unit includes an air input port to supply the interior of the expander unit with gas and each drier cassette includes an air input port to supply the interior of the drier cassette with gas.

23. The cassette expander unit system for a drier for drying printed matter of claim 20 wherein at least one of the lengthwise sides of each expander unit has a window aperture in its lengthwise side and that lengthwise side is joined to the lengthwise side of a drier cassette having a window aperture, so that gas can communicate between the interior of the drier cassette and the interior of the expander unit.

24. The cassette expander unit system for a drier for drying printed matter of claim 23 wherein a drier cassette includes an air input port to supply the interior of an expander unit with gas through a window aperture.

25. The cassette expander unit system for a drier for drying printed matter of claim 23 wherein an expander unit includes an air input port to supply the interior of a drier cassette with gas through a window aperture.

26. The cassette expander unit system for a drier for drying printed matter of claim 20 including an expander unit that is adapted to be joined to a drier cassette on a single lengthwise side, has a window aperture to communicate gas with the adjoining drier cassette, and, the exhaust openings in the bottom side of are regulated to emit gas at an exhaust pressure that is different from that of the exhaust pressure of an adjoined drier cassette.

27. The cassette expander unit system for a drier for drying printed matter of claim 26 wherein the exhaust openings in the bottom side of the expander unit are regulated to emit a gas at an exhaust pressure that varies from that of the drier cassette exhaust pressure by providing exhaust openings in the bottom side of the box that progressively increase in size from distal to proximal the lengthwise side having a window aperture.

28. The cassette expander unit system for a drier for drying printed matter of claim 26 wherein the exhaust openings in the bottom side of the expander unit box are regulated to emit a gas at an exhaust pressure that varies from that of the drier cassette exhaust pressure by providing exhaust openings in the bottom side of the box that progressively increase in density from distal to proximal the lengthwise side having a window aperture.

29. The cassette expander unit system for a drier for drying printed matter of claim 26 wherein the exhaust openings in the bottom side of an expander unit box are regulated to emit a gas at an exhaust pressure that varies from that of the drier cassette exhaust pressure by providing a choke in a window aperture between the drier cassette an expander unit.

30. The cassette expander unit system for a drier for drying printed matter of claim 26 wherein the exhaust openings in the bottom side of an expander unit box are regulated to emit a gas at an exhaust pressure that varies from that of the drier cassette exhaust pressure by providing a gas supply of different pressures to the drier cassettes and the expander units.

31. The cassette expander unit system for a drier for drying printed matter of claim 20 wherein at least one of the lengthwise sides of the one or more expander units that is adapted to join to and support a drier cassette is formed as part of a dovetail joint.

32. The cassette expander unit system for a drier for drying printed matter of claim 20 wherein the bottom side of a drier cassette includes heat emitters, or, the bottom side of an expander unit box includes heat emitters.

33. The cassette expander unit system for a drier for drying printed matter of claim 20 wherein each of the lengthwise sides of the one or more drier cassettes has a window aperture and is joined to two expander units that have a window aperture in the adjoining lengthwise side of each expander unit.

34. The cassette expander unit system for a drier for drying printed matter of claim 33 wherein lengthwise sides of each drier cassette and expander unit are joined with a dovetail joint.

35. A method for drying printed matter comprising the steps of:

a) providing a cassette expander unit system for a drier for drying printed matter, comprising one or more expander units that are each a box that has an interior and that is fixedly attached to a surface, has a top side, a bottom side, a front side, a back side and two lengthwise sides, at least one of the lengthwise sides being adapted to be releasably joined to and support a drier cassette, each expander unit being adapted to be supplied with a flow of gas to the interior and further where the bottom side of the expander unit has a plurality of exhaust openings to exhaust the gas, said cassette expander unit system further comprising one or more drier cassettes, that each have an interior and a top side, a bottom side, a front side, a back side and two lengthwise sides, at least one of the lengthwise sides being adapted to be releasably joined to and be supported by at least one expander unit, the drier cassette being further adapted to be supplied with a flow of gas and where the bottom side of the drier cassette has a plurality of exhaust openings to exhaust the gas, wherein each of the one or more drier cassettes is joined to and supported by at least one expander unit so that the bottom sides of the expander unit and the drier cassette are oriented in the same direction, b) providing a supply of gas to the interior of one or more expander units, or, to one or more drier cassettes, and c) passing printed matter through the resulting exhaust from the exhaust openings of the drier cassettes and the expander units.

36. The method for drying printed matter of claim 35 wherein one or more of the expander unit includes an air input port to supply the interior of the expander unit with gas and each drier cassette includes an air input port to supply the interior of the expander unit with gas.

37. The method for drying printed matter of claim 36 wherein each of the lengthwise sides of the one or more drier cassettes has a window aperture and is joined to two expander units that each have a window aperture in the adjoining lengthwise side of the expander unit, whereby gas can communicate between all adjoining expander units and drier cassettes.

38. The method for drying printed matter of claim 35 wherein at least one of the lengthwise sides of an expander unit has a window aperture in its lengthwise side and that lengthwise side is joined to the lengthwise side of a drier cassette having a window aperture in its lengthwise side, so that the gas supplied to either can communicate between the interior of the drier cassette and the interior of the expander unit.

39. The method for drying printed matter of claim 38 wherein one of the one or more drier cassettes includes an air input port to supply the interior of an adjoined expander unit with gas.

40. The method for drying printed matter of claim 38 wherein one of the one or more expander units includes an air input port that also supplies gas to the interior of an adjoined drier cassette with gas.

41. The method for drying printed matter of claim 35 wherein the exhaust openings in the bottom side of at least one of the one or more expander units are regulated to emit gas at an exhaust pressure that is different from that of a drier cassette.

42. The method for drying printed matter of claim 41 wherein the expander unit has window aperture on a single side, the plurality of exhaust openings in the bottom side of the expander unit are regulated to emit a gas at an exhaust pressure that varies from that of the drier cassette exhaust pressure by providing exhaust openings in the bottom side of the box that progressively increase in size from distal to proximal the lengthwise side having a window aperture.

43. The method for drying printed matter of claim 41 wherein the expander unit has window aperture on a single side, the plurality of exhaust openings in the bottom side of the expander unit box are regulated to emit a gas at an exhaust pressure that varies from that of the drier cassette exhaust pressure by providing exhaust openings in the bottom side of the box that progressively increase in density from distal to proximal the lengthwise side having a window aperture.

44. The method for drying printed matter of claim 41 wherein the expander unit has window aperture on a single side, the plurality of exhaust openings in the bottom side of the expander unit box are regulated to emit a gas at an exhaust pressure that varies from that of the drier cassette exhaust pressure by providing a choke in a window aperture provided in the drier cassette and in the expander unit to allow gas to communicate therebetween.

45. The method for drying printed matter of claim 41 wherein the expander unit has window aperture on a single side, the plurality of exhaust openings in the bottom side of the expander unit box are regulated to emit a gas at an exhaust pressure that varies from that of the drier cassette exhaust pressure by providing a gas supply to an expander unit that varies in pressure to that provided to a drier cassette.

* * * * *